US009097120B2

(12) United States Patent
Petitjean et al.

(10) Patent No.: US 9,097,120 B2
(45) Date of Patent: Aug. 4, 2015

(54) TURBINE HOUSING ASSEMBLY

(75) Inventors: Dominique Petitjean, Julienrupt (FR); Guillaume Dupont, Thaon les Vosges (FR); Anthony Ruquart, Epinal (FR); Philippe Arnold, Hennecourt (FR); Manimurugan Palaniyappan, Zlin (CZ); Manuel Marques, Flavigny sur Moselle (FR); Jean-Jacques Laissus, Morristown, NJ (US); Raphael Ceotto, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 1154 days.

(21) Appl. No.: 12/869,307

(22) Filed: Aug. 26, 2010

(65) Prior Publication Data

US 2012/0051899 A1 Mar. 1, 2012

(51) Int. Cl.

| | |
|---|---|
| ***F02D 23/00*** | (2006.01) |
| ***F04D 29/44*** | (2006.01) |
| ***F04B 17/00*** | (2006.01) |
| ***F01D 9/02*** | (2006.01) |
| ***F01D 21/04*** | (2006.01) |
| ***F01D 25/24*** | (2006.01) |

(52) U.S. Cl.

CPC ..... *F01D 9/026* (2013.01); *F01D 21/045* (2013.01); *F01D 25/24* (2013.01); *F05D 2220/40* (2013.01); *F05D 2230/21* (2013.01); *F05D 2230/232* (2013.01)

(58) Field of Classification Search

CPC ..... F01D 9/026; F01D 21/045; F01D 25/24; F05D 2230/232; F05D 2220/40; F05D 2230/21

USPC ..... 60/602; 415/157, 204, 207; 417/407

See application file for complete search history.

(56) References Cited

U.S. PATENT DOCUMENTS

| | | | | |
|---|---|---|---|---|
| 4,181,466 | A * | 1/1980 | Owen | 415/204 |
| 4,655,043 | A | 4/1987 | McInerney | |
| 5,231,831 | A * | 8/1993 | Leavesley | 60/602 |
| 6,951,450 | B1 | 10/2005 | Figura et al. | |
| 2007/0130943 | A1 * | 6/2007 | Sausse et al. | 60/602 |

FOREIGN PATENT DOCUMENTS

| | | | |
|---|---|---|---|
| EP | 834646 | A1 | 4/1998 |
| JP | 2003035153 | A | 2/2003 |
| JP | 3489332 | B2 | 1/2004 |
| WO | 2009031940 | A1 | 8/2009 |

* cited by examiner

*Primary Examiner* — Kenneth Bomberg
*Assistant Examiner* — Paolo Isada
(74) *Attorney, Agent, or Firm* — Brian J. Pangrle

(57) ABSTRACT

An assembly includes a cast cartridge component and a curved wall where the cast cartridge includes a base plate having an opening configured for receipt of a turbine wheel, an exhaust conduit having an inlet and an outlet, a cylindrical wall, and vanes disposed between the cylindrical wall and the base plate where adjacent vanes define throats; where the curved wall includes a proximal end and a distal end, and an upper edge and a lower edge; and where joinder of the proximal end and the outlet of the exhaust conduit, joinder of the upper edge and the cylindrical wall and joinder of the lower edge and the base plate forms a volute configured to direct exhaust received via the inlet to a turbine wheel via the throats. Various other examples of devices, assemblies, systems, methods, etc., are also disclosed.

19 Claims, 14 Drawing Sheets

TURBINE HOUSING ASSEMBLY

RELATED APPLICATION

This patent application is related to, and incorporates by reference herein, US patent application entitled "Turbine housing assembly with wastegate" having Ser. No. 12/869,343, which was filed on Aug. 26, 2010.

TECHNICAL FIELD

Subject matter disclosed herein relates generally to turbomachinery for internal combustion engines and, in particular, to turbine housings.

BACKGROUND

Many conventional turbine housings are cast with an integral volute and combined with a variety of components to form a turbine housing assembly suitable to receive and house a turbine wheel. Various turbine housing assemblies are presented herein that provide advantages when compared to such conventional turbine housing assemblies.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
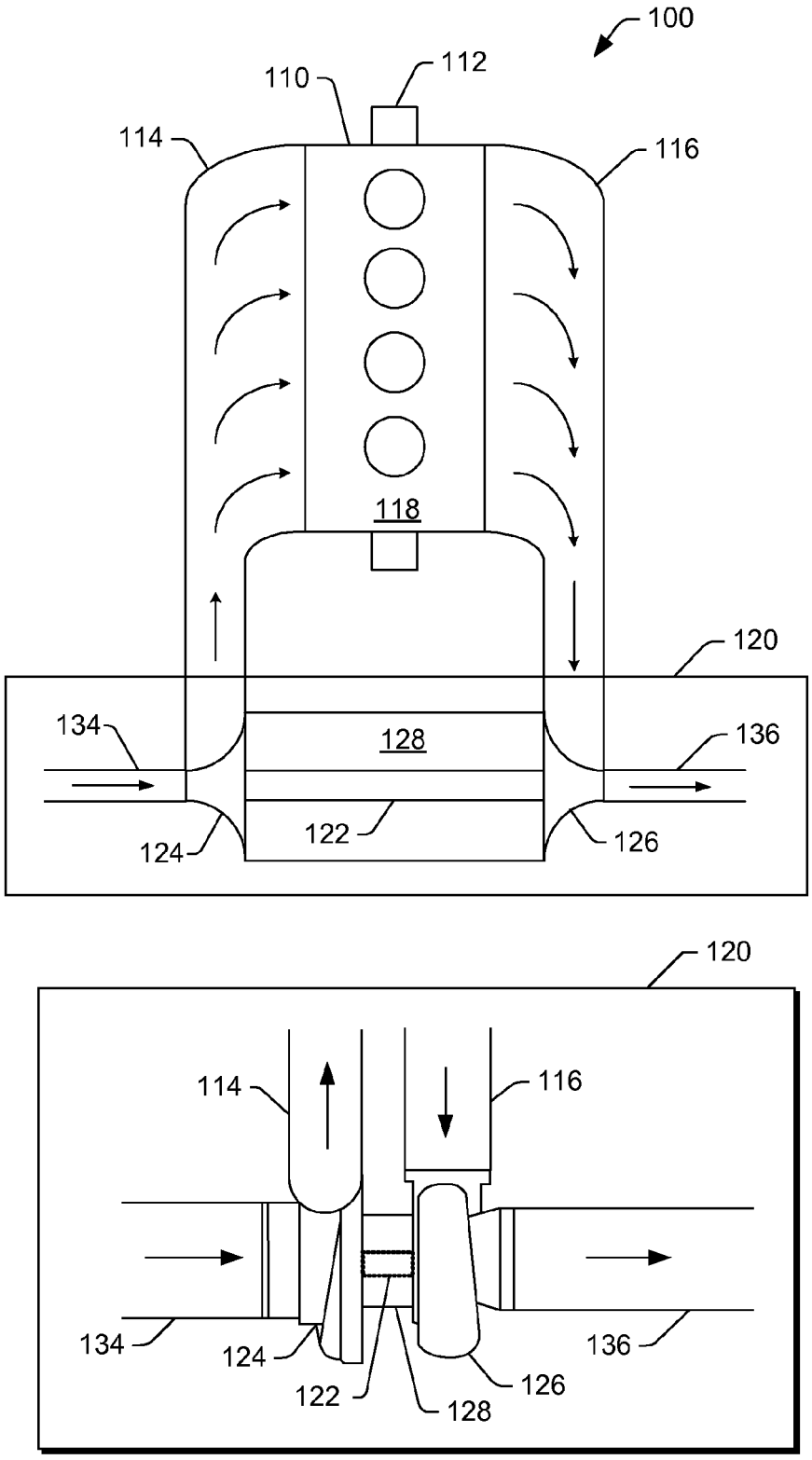
FIG. 1 is a diagram of a turbocharger and an internal combustion engine.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112. As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components.

Figure 2:
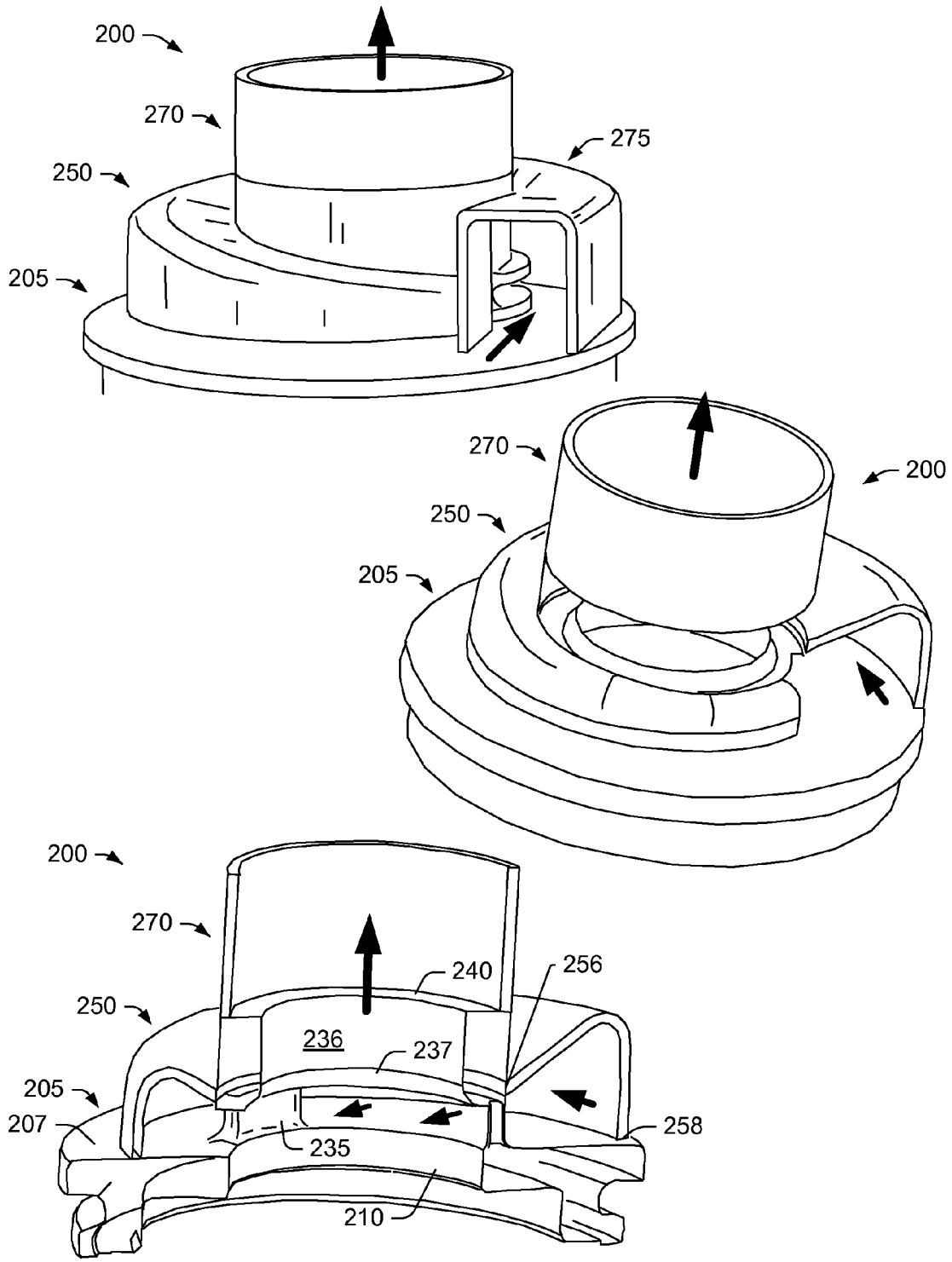
FIG. 2 is a series of perspective views and a cross-sectional view of an example of a turbine housing assembly.

FIG. 2 shows an example of a turbine housing assembly 200 that includes a cartridge component 205, a volute component 250 and an outlet component 270. The cartridge component 205 includes an upper surface 207, an opening 210 configured for receipt of a turbine wheel and supports 235 that extend from the upper surface 207 and support a cylindrical wall 236 that has a contoured shroud portion 237. FIG. 2 shows a perspective view, a perspective with a cut-away of the cylindrical wall 236 and a cross-sectional view with internal transparency of the cartridge component 205.

As described herein, a cartridge component may be a single cast piece with or without one or more voids. For example, the cartridge 205 may be a single cast piece that includes the supports 235 and the cylindrical wall 236 without or with voids (e.g., where voids may act to reduce weight, control heat transfer, etc.).

In the example of FIG. 2, the volute component 250 is a curved wall that includes an upper edge 256 and a lower edge 258 as well as an inlet portion 275 that forms an inlet for receipt of exhaust. The upper edge 256 abuts the cylindrical wall 236 while the lower edge 258 abuts the upper surface 207 of the cartridge component 205. In such an arrangement, the cartridge component 205 and the volute component 250 form a volute that can receive exhaust and provide exhaust to a turbine wheel space. As shown in a lower, cross-sectional view, the outlet component 270 is seated on top of the wall 236. The upper edge 256 of the volute component 250 generally includes at least a portion with an arcuate shape (e.g., matched to abut the cylindrical wall 236).

As described herein, a cast component can provide a durable shroud or wheel contour. Further, where the cartridge component 205 is cast, it can provide some degree of burst containment. Specifically, in the example of FIG. 2, where the cartridge component 205 is cast, upon burst of a turbine wheel, various features of the cartridge component 205, if remaining intact (e.g. material defining the opening 210, the supports 235 and the cylindrical wall 236), can help contain and absorb energy from debris, leaving only the spaces between the supports 235 and an opening 240 defined by the cylindrical wall 236 as possible ejection pathways.

Where the cartridge component 205 is cast, it can also provide support for attachment to of the turbine housing assembly 200 to a bearing housing (e.g., a turbocharger center housing), for example, via a V-band fixation mechanism as shown in FIG. 2 or other fixation mechanism.

As described herein, a cast cartridge component can include a V-band for fixation and a wheel contour. Such a cartridge component can provide various benefits and allow for use of various types of volute components and outlet components. For example, a volute component may be tailored to provide particular operational characteristics. Specifically, a volute component may be shaped to for a particular volute volume, cross-sectional area, cross-sectional shape, etc. Use of a separate volute component can also allow for flow surface modification, for example, polishing, indicia to direct flow, etc. Such parameters may provide for reduced frictional losses and improved flow fields as well as tailoring exhaust flow to a turbine wheel or matching a volute component to a particular turbine wheel or family of turbine wheels, optionally for certain operational conditions (e.g., low load, high load, etc.).

As described herein, a turbine housing assembly with a cast cartridge component, such as the assembly 205, can reduce mass and retention of heat. For example, a conventional cast turbine housing with an integral cast volute typically requires more material, contains more mass and will retain more heat. In comparison, a volute component, such as the volute component 250, can be made of a material that has a lesser mass, lesser thickness, lesser heat capacity, etc., which may be expected to retain less heat. Further, casting may be simplified for a cartridge component compared to a cast turbine housing with an integral volute. Further, cleaning and examination of features of a cast cartridge may be performed more readily compared to a cast volute where a special tool or tools may be required to clean a cast or examine cast quality (e.g., inner surface of the volute). As described herein, a volute component may be formed from sheet metal, a light-weight high temperature composite material (e.g., ceramic matrix composites), or other material.

As described herein, an assembly can include a cartridge component that has a base plate having an opening configured for receipt of a turbine wheel, a cylindrical wall, and vanes disposed between the cylindrical wall and the base plate where adjacent vanes define throats; and a curved wall that includes a proximal end and a distal end, and an upper edge and a lower edge. In the foregoing example, the proximal end of the curved wall can form an inlet for exhaust and joinder of the upper edge and the cylindrical wall and joinder of the lower edge and the base plate can form a volute where the volute is configured to direct exhaust received via the inlet to a turbine wheel via the throats.

Figure 3:
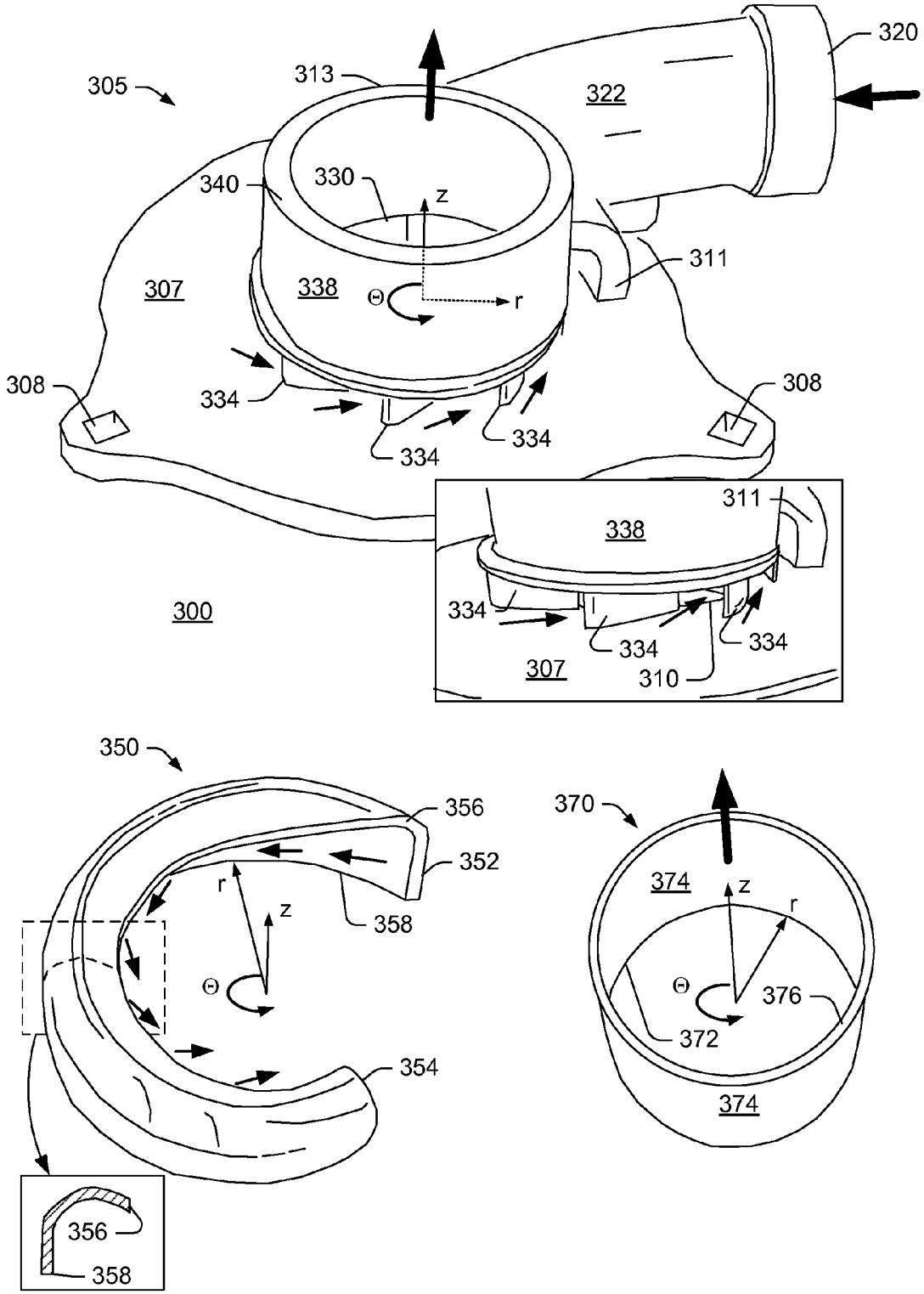
FIG. 3 is a series of perspective views of components of an example of a turbine housing assembly.

FIG. 3 shows an example of a turbine housing assembly 300 that includes a cartridge component 305, a volute component 350 and an outlet component 370. The components 305, 350 and 370 are shown in FIG. 3 with respect to a cylindrical coordinate system having an axial "z" coordinate, a radial "r" coordinate and an azimuthal "Θ" coordinate (see, e.g., Beyer, W. H., *CRC Standard Mathematical Tables,* 28th ed. Boca Raton, Fla.: CRC Press, p. 212, 1987).

The cartridge component 305 is configured to receive exhaust via an inlet 320 of an exhaust conduit 322, where the exhaust conduit 322 may be cast integral to the base plate 307. The base plate 307 may include openings 308 for receipt of rods, bolts, or other components for mounting or fixation of the turbine hosing assembly 300 where the openings 308 are positioned near a maximal radial dimension of the base plate 307. As seen in an enlarged view, the base plate 307 includes an opening 310 configured for receipt of a turbine wheel. The opening 310 may be defined by a radial dimension slightly larger than a radius of a turbine wheel.

In the example of FIG. 3, the cartridge component 305 further includes a cylindrical wall 338 with an outlet 340 and vanes 334 disposed between the cylindrical wall 338 and the base plate 307 where adjacent vanes 334 define throats. At trailing edges of the vanes 334, the throats open at a gap 330. An axial height of the gap 330 may be defined by an axial dimension of one or more of the vanes 334. Different vanes 334 may differ in axial height and therefore result in a varying height for the gap 330 (e.g., an axial dimension for the gap 330 that varies about the angle Θ). Each of the vanes 334 may be defined via a line passing between a trailing edge and a leading edge where the line forms a vane angle, for example, an angle defined with respect to a radial line extending from the z-axis to the vane's trailing edge. In general, the vanes 334 are fixed (e.g., formed at a fixed vane angle). Each vane may have a particular shape that differs from one or more other vanes, for example, where the shape of a vane depends on position of the vane about the azimuthal angle. In various examples, all vanes may have the same shape, the same height and the same vane angle.

In the example of FIG. 3, the volute component 350 is a curved wall that curves about the azimuthal dimension and that includes a proximal end 352 and a distal end 354 and an upper edge 356 and a lower edge 358. As shown in a cross-sectional view for a specific angle Θ, the volute component 350 has a particular shape; noting that the cross-sectional shape of the volute component 350 varies with respect to the angle Θ. As described herein, the cross-sectional shape of the volute component 350 may be tailored to achieve one or more goals.

Upon assembly of the cartridge component 305 and the volute component 350, the upper edge 356 abuts the cylindrical wall 338 while the lower edge 358 abuts the upper surface 307 of the cartridge component 305. Further, the proximal end 352 abuts an outlet 313 of the exhaust conduit 322 and the distal end 354 abuts an arched wall 311, for example, that may define an opening to allow for exhaust to reach a turbine wheel from 360 degrees or approximately 360 degrees. In such an arrangement, the cartridge component 305 and the volute component 350 form a volute that can receive exhaust via the conduit 322 and provide exhaust to a turbine wheel space via the throats of the vanes 334.

In the example of FIG. 3, the outlet component 370 is configured as a cylindrical wall 374 that extends between and defines an inlet 372 and an outlet 376. The outlet component 370 may be seated with respect to the cartridge component 305 such that the outlet 340 of the cartridge component 305 provides for flow of exhaust to the inlet 327 of the outlet component 370. For example, as shown in FIG. 3, the outlet component 370 may be an extension for the cylindrical wall 338 of the cartridge component 305. As described herein, the axial dimension of the cylindrical wall 338 may be minimized to reduce weight yet sufficient to provide integrity, form an ample shroud for a turbine wheel, etc. The outlet component 370 may be made from a material that differs from that of the cartridge component 305.

As described herein, an assembly can include a cast cartridge component that includes a base plate having an opening configured for receipt of a turbine wheel, an exhaust conduit having an inlet and an outlet, a cylindrical wall, and vanes disposed between the cylindrical wall and the base plate where adjacent vanes define throats; and a curved wall that includes a proximal end and a distal end, and an upper edge and a lower edge; where joinder of the proximal end and the outlet of the exhaust conduit, joinder of the upper edge and the cylindrical wall and joinder of the lower edge and the base plate forms a volute configured to direct exhaust received via the inlet to a turbine wheel via the throats.

As described herein, a curved wall may be shaped to correspond to a select turbine wheel and, further, an assembly or kit may include multiple curved walls having different shapes, where one of the curved walls is selected for joinder to the cast component. As described herein, a base plate can include openings where each opening is configured to receive a rod or other piece to clamp a bearing housing between the base plate and a compressor. In such an arrangement, a turbine housing assembly may include a heat shield configured for placement adjacent the base plate.

As described herein, an exhaust conduit may have an axis oriented substantially parallel to a plane defined by a base plate. As described herein, a cylindrical wall of a cartridge component may have an axis oriented substantially perpendicular to a plane defined by a base plate of the cartridge component. As described herein, an exhaust conduit can include a socket configured for joinder with a distal end of a curved wall (e.g., a volute component).

As mentioned, a turbine housing assembly may include a curved wall joined to a cast cartridge component. In such an example, the curved wall and the cast cartridge component may be joined via welded joints. Depending on configuration, other types of joinder may be employed (e.g., where risk of exhaust leakage is acceptably minimized).

Figure 4:
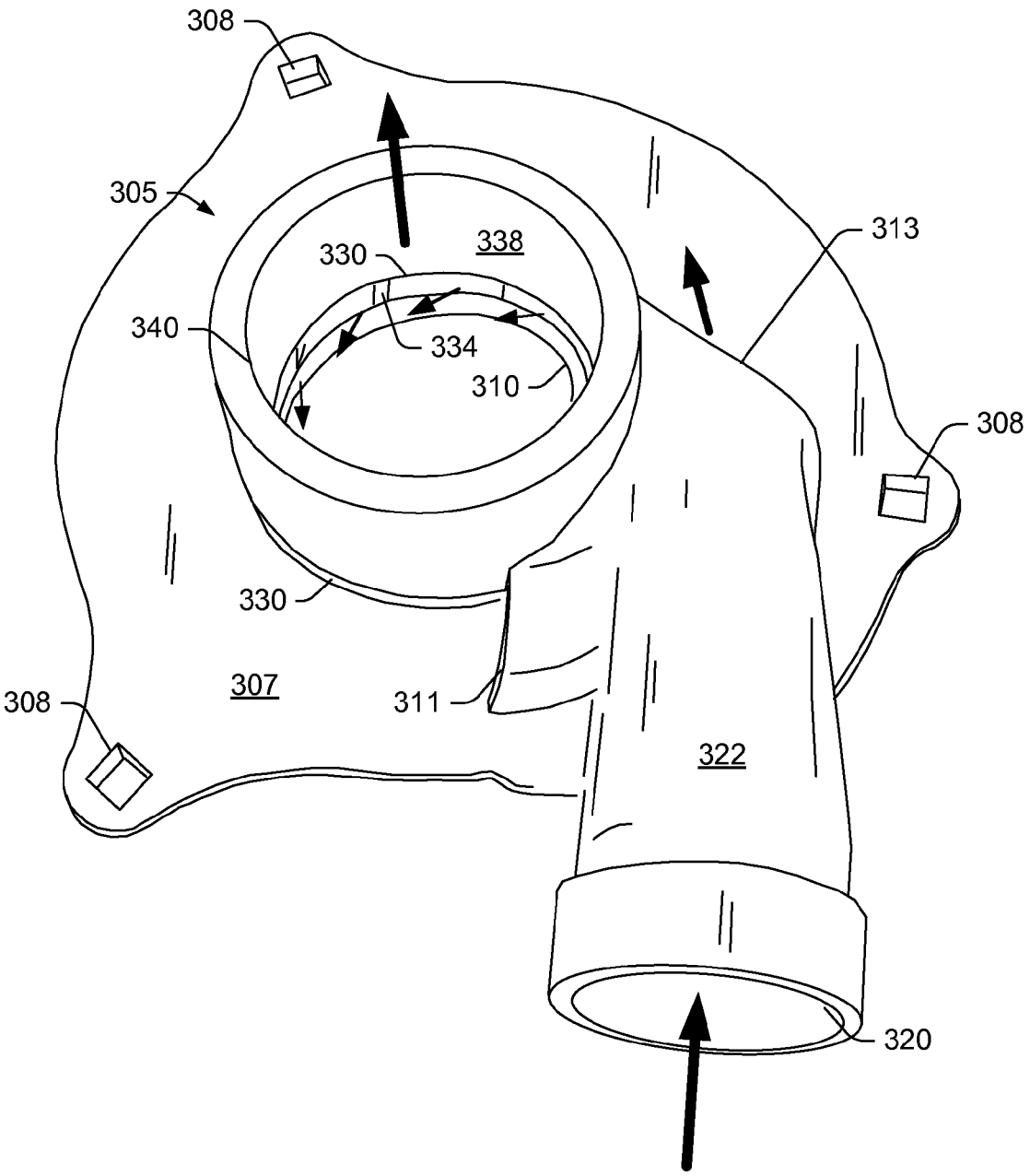
FIG. 4 is a perspective view of the cartridge component of FIG. 3.

FIG. 4 shows a perspective view of the cartridge component 305 of FIG. 3. In FIG. 4, the arched wall 311 and the outlet 313 are shown with respect to the conduit 322 and as being integral parts of the conduit 322.

Figure 5:
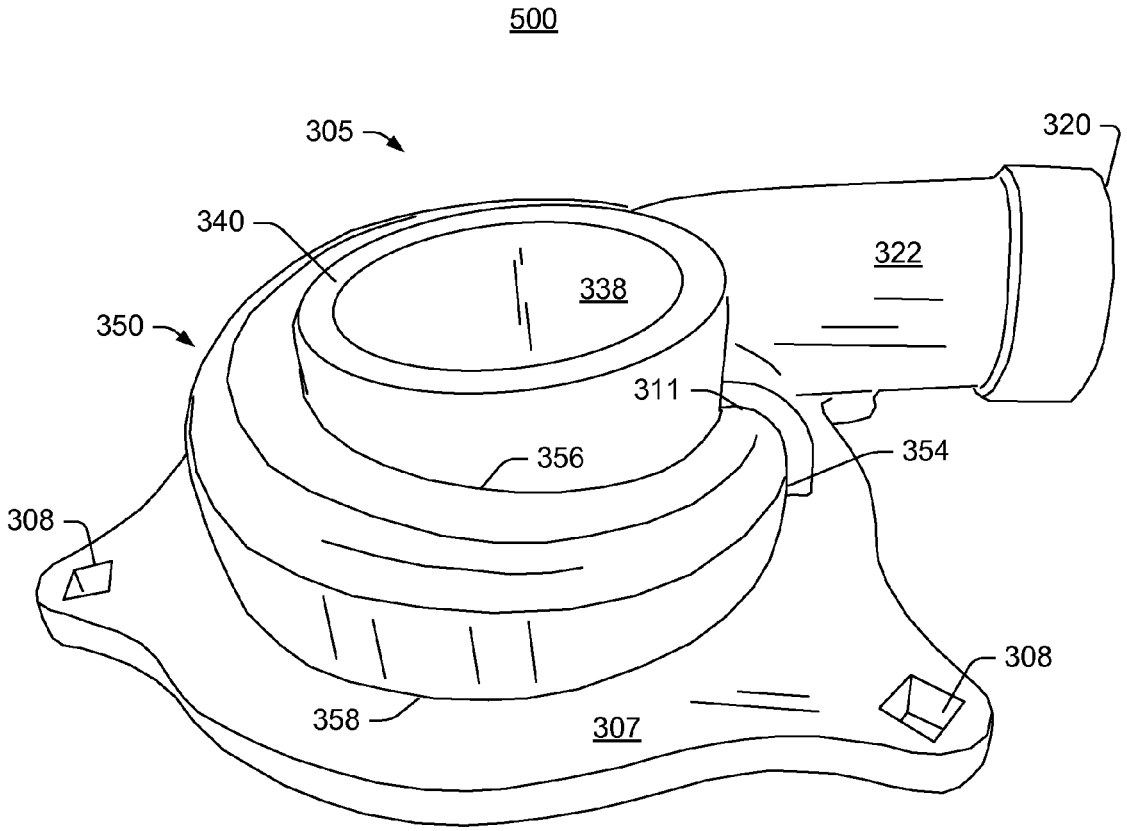
FIG. 5 is a perspective view of an assembly that includes the cartridge component and the volute component of FIG. 3.

FIG. 5 shows a perspective view of an assembly 500 that includes the cartridge component 305 and the volute component 350. In FIG. 5, the arched wall 311 defines an opening for receipt of the distal end 354 of the volute component 350.

Figure 6:
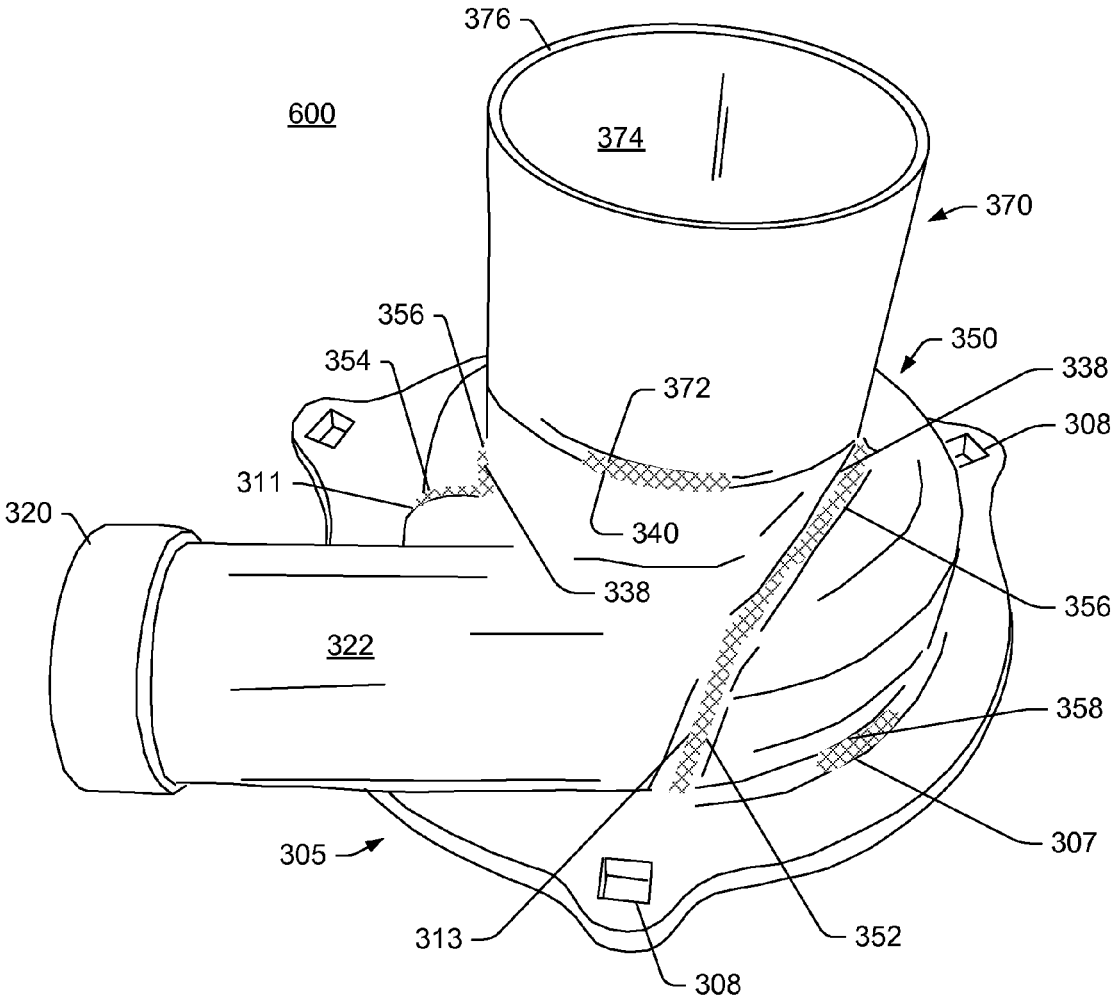
FIGS. 6 and 7 are perspective views of an assembly that includes the cartridge component, the volute component and the outlet component of FIG. 3.
Figure 7:
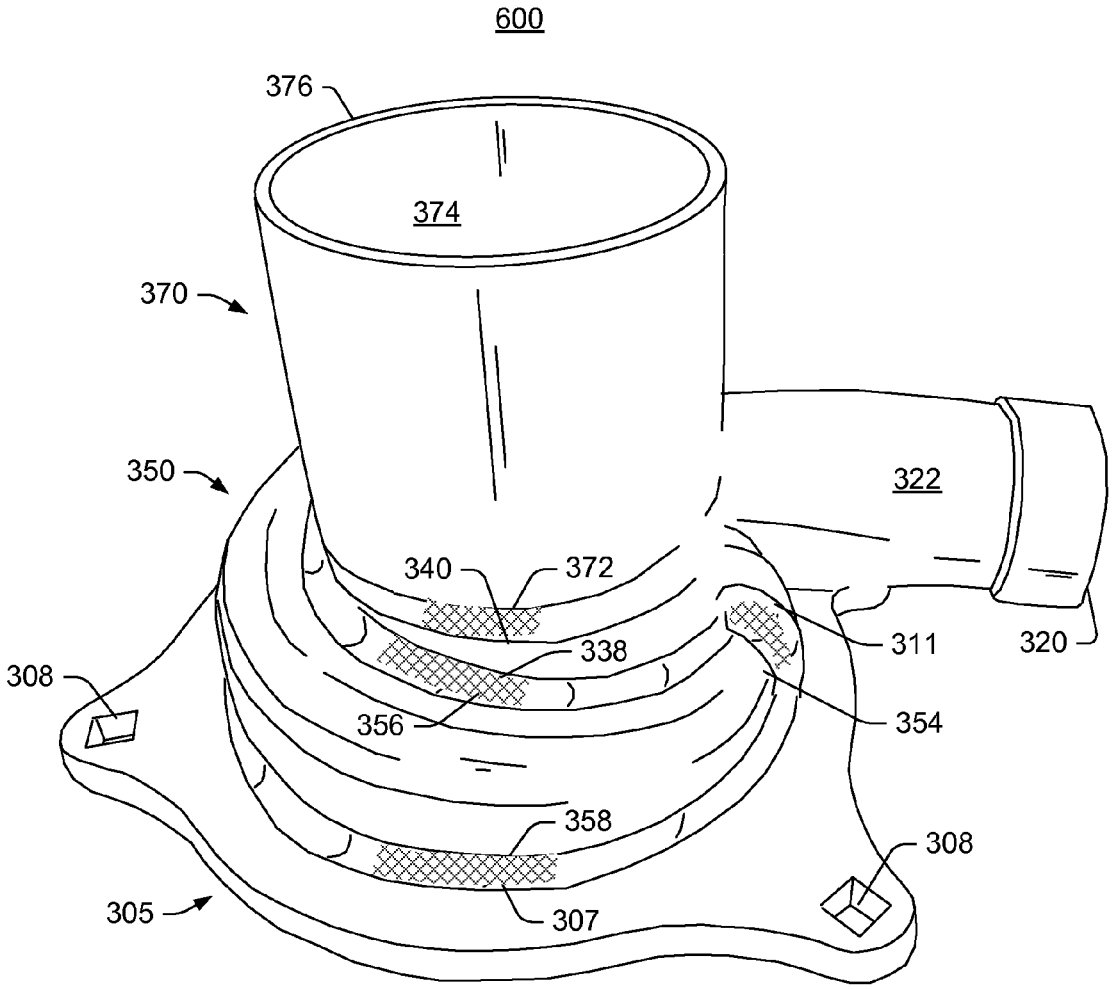

FIGS. 6 and 7 show perspective views of an assembly 600 that includes the cartridge component 305, the volute component 350 and the outlet component 370. In FIGS. 6 and 7, hatched lines indicate joinder of the various components via welds that exist between the base plate 307 and the lower edge 358 of the volute component 350, between the outlet 313 of the conduit 322 and the end 352 of the volute component 350, between the upper edge 356 of the volute component 350 and the cylindrical wall 338, between the inlet 372 of the outlet component 370 and the outlet 340 of the cylindrical wall 340, and between the end 354 of the volute component 350 and the arched wall 311 of the cartridge component 305. Welds may be made via any of a variety of processes (thermal, chemical, etc.), which may depend on materials of construction of the various components.

Figure 8:
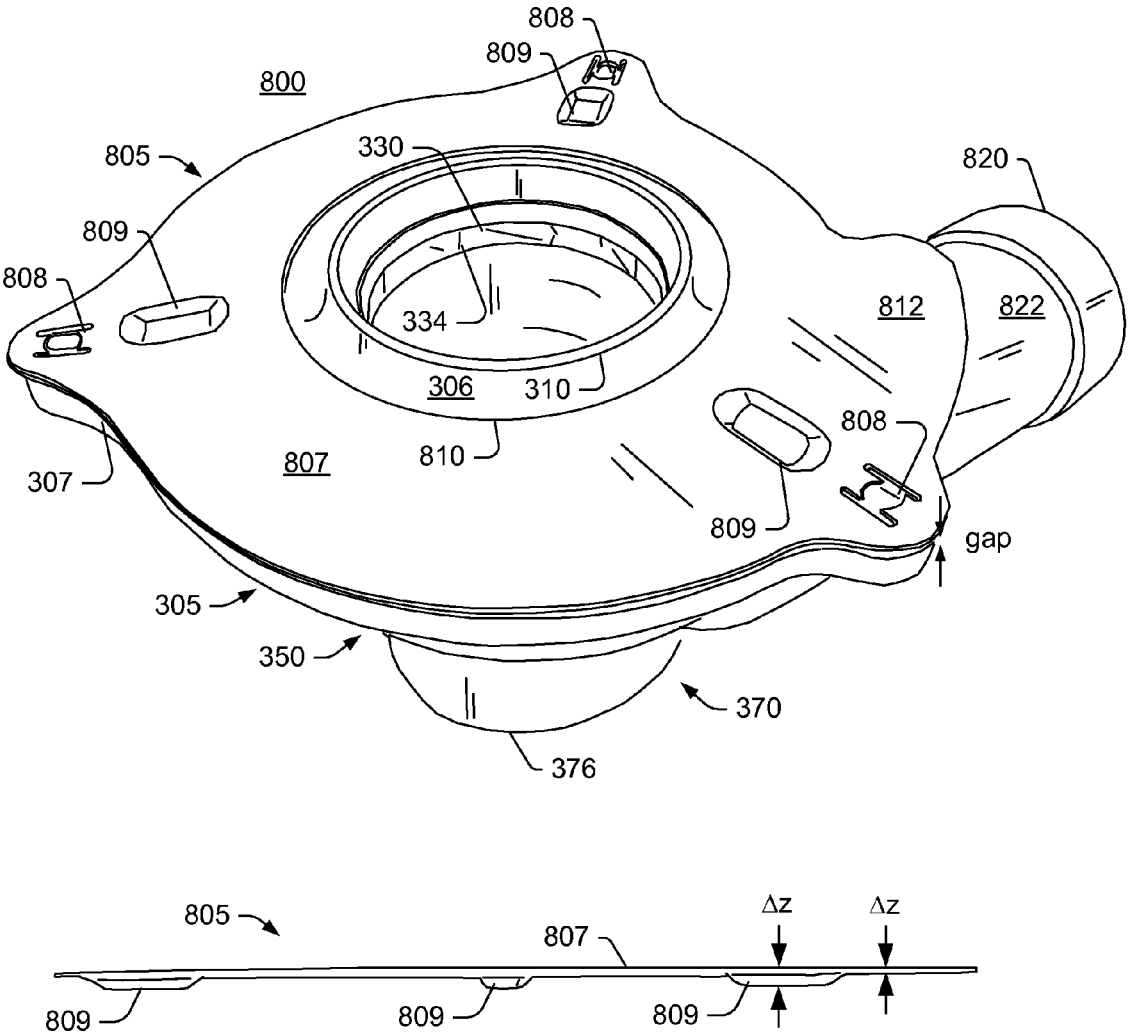
FIG. 8 is a perspective view of an assembly that includes an example of a heat shield as well as a side view of the heat shield.

FIG. 8 shows a perspective view of an assembly 800 that includes a heat shield 805 as well as a side view of the heat shield 805. In the example of FIG. 8, the heat shield 805 includes fixation openings 808, spacers 809, a central opening 810 as well as a tongue 812 that extends in a direction along the axis of the conduit 322. FIG. 8 also shows a lip 306 that surrounds the opening 310 of the cartridge component 305.

In the example of FIG. 8, the spacers 808 may be stamped or otherwise formed in a flat piece of material (e.g., metal, composite material, etc.). The spacers 808 ensure that a substantially flat portion 807 of heat shield 805 is maintained a distance from the base component 305, for example, to provide a space for air.

Figure 9:
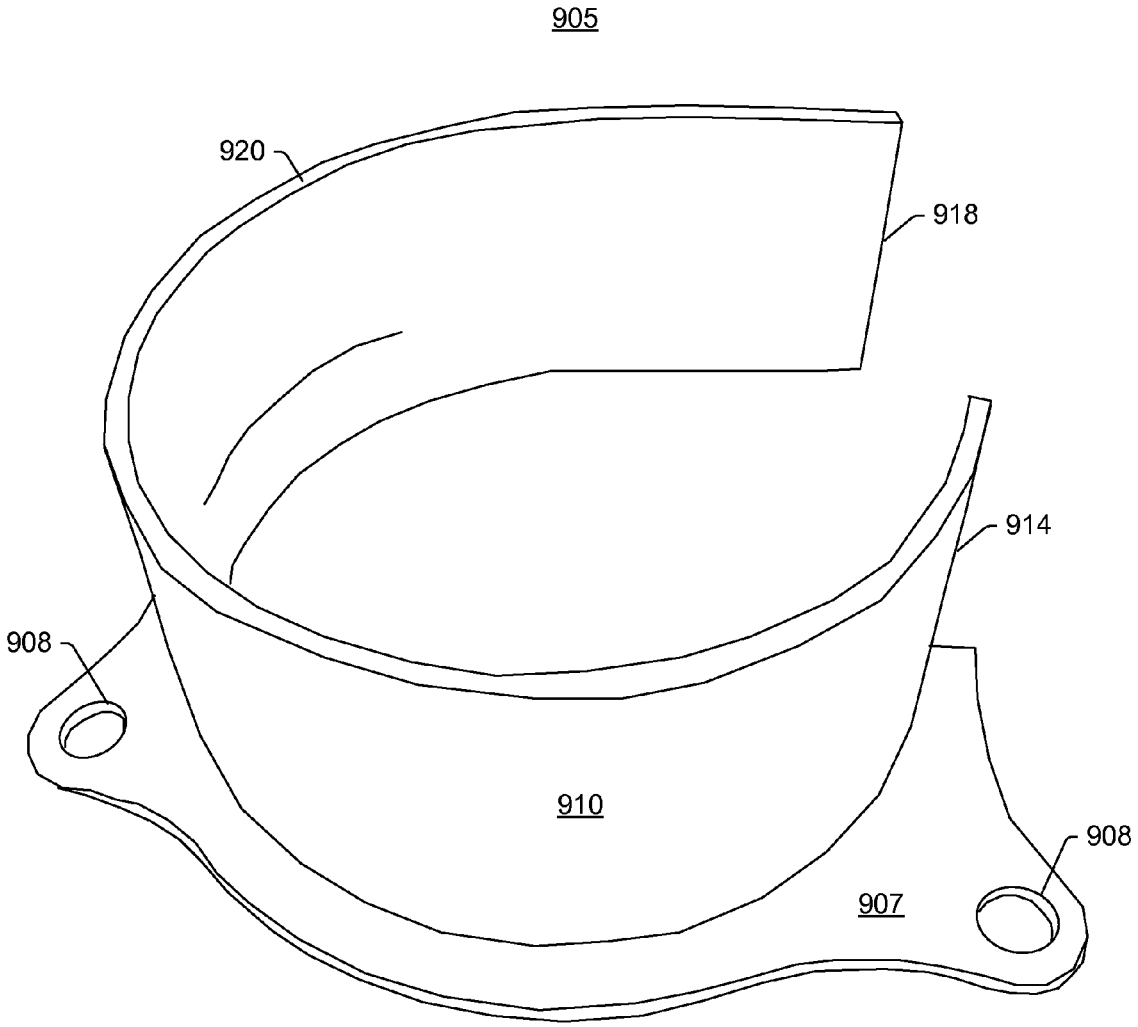
FIG. 9 is a perspective view of an example of a burst shield.

FIG. 9 shows an example of a burst shield 900. The burst shield 900 includes a base 907 and a wall 910 having ends 914 and 918 and an upper edge 920. The base 907 includes openings 908 for mounting to a turbine housing assembly. The ends 914 and 918 define a gap, for example, of sufficient width to accommodate a conduit of the turbine housing assembly.

Figure 10:
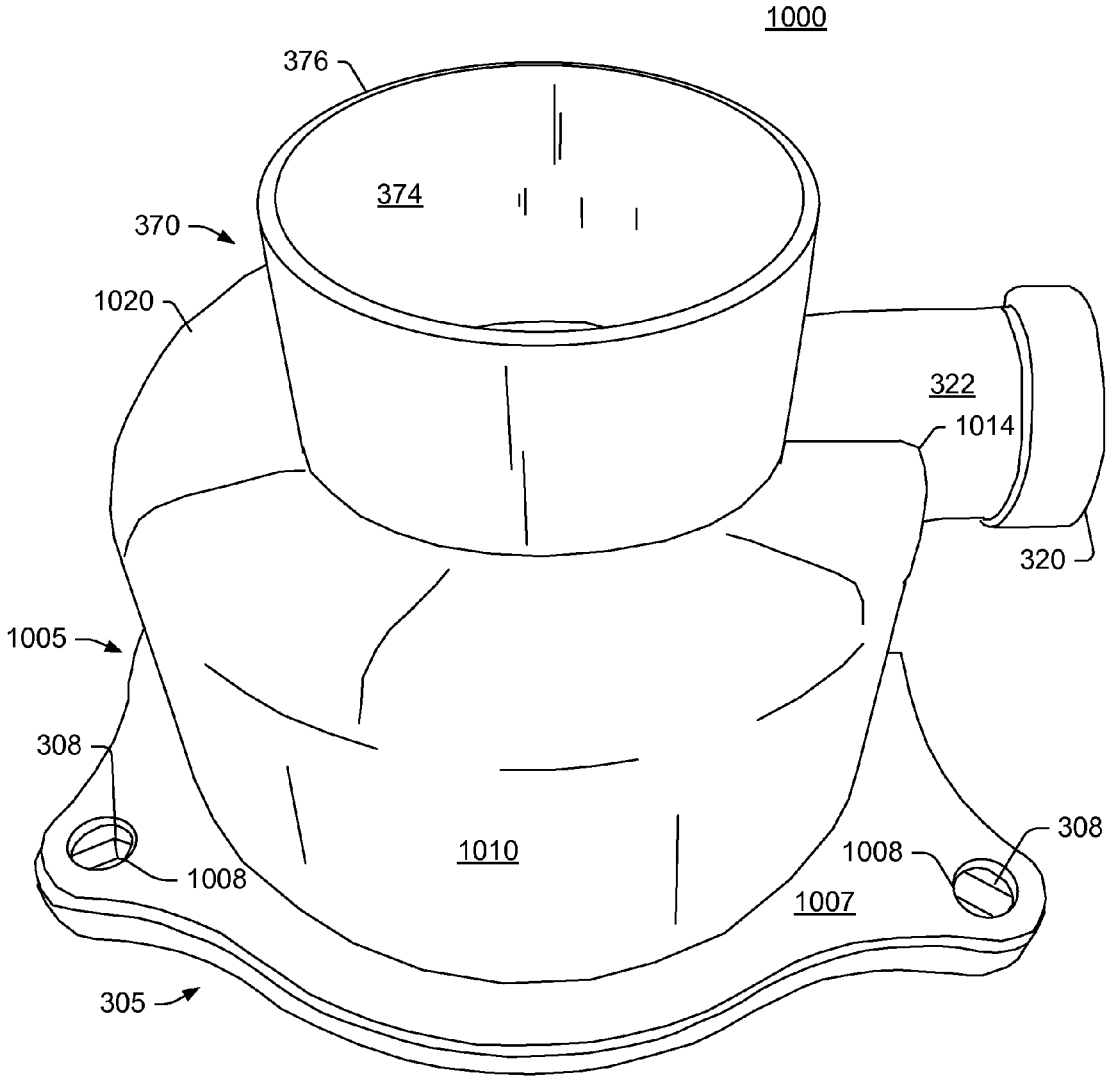
FIG. 10 is a perspective view of an assembly that includes the cartridge component, the volute component, the outlet component of FIG. 3 and another example of a burst shield.

FIG. 10 shows a perspective view of an assembly 1000 that includes the cartridge component 305, the volute component 350, the outlet component 370 and a burst shield 1005. The burst shield 1005 has features similar to the burst shield of FIG. 9 but further includes a cover portion 1020. The cover 1020 and a surrounding wall 1010 present barriers to debris in the instance a burst occurs. These features also act as barriers to heat transfer, which can diminish radiation and shorten warm up times of a turbine assembly. Diminishing radiation can be important to reduce impact on surrounding components, for example, electrical components that may be sensitive to external radiation. As shown in FIG. 10, openings 1008 of the burst shield 1005 align with the openings 308 of the base plate 307 of the cartridge component 305. Further, the burst shield 1005 is configured such that the ends 1014 and 1018 (not shown, e.g., akin to 918 of FIG. 9) provide clearance for the conduit 322 of the cartridge component 305.

Figure 11:
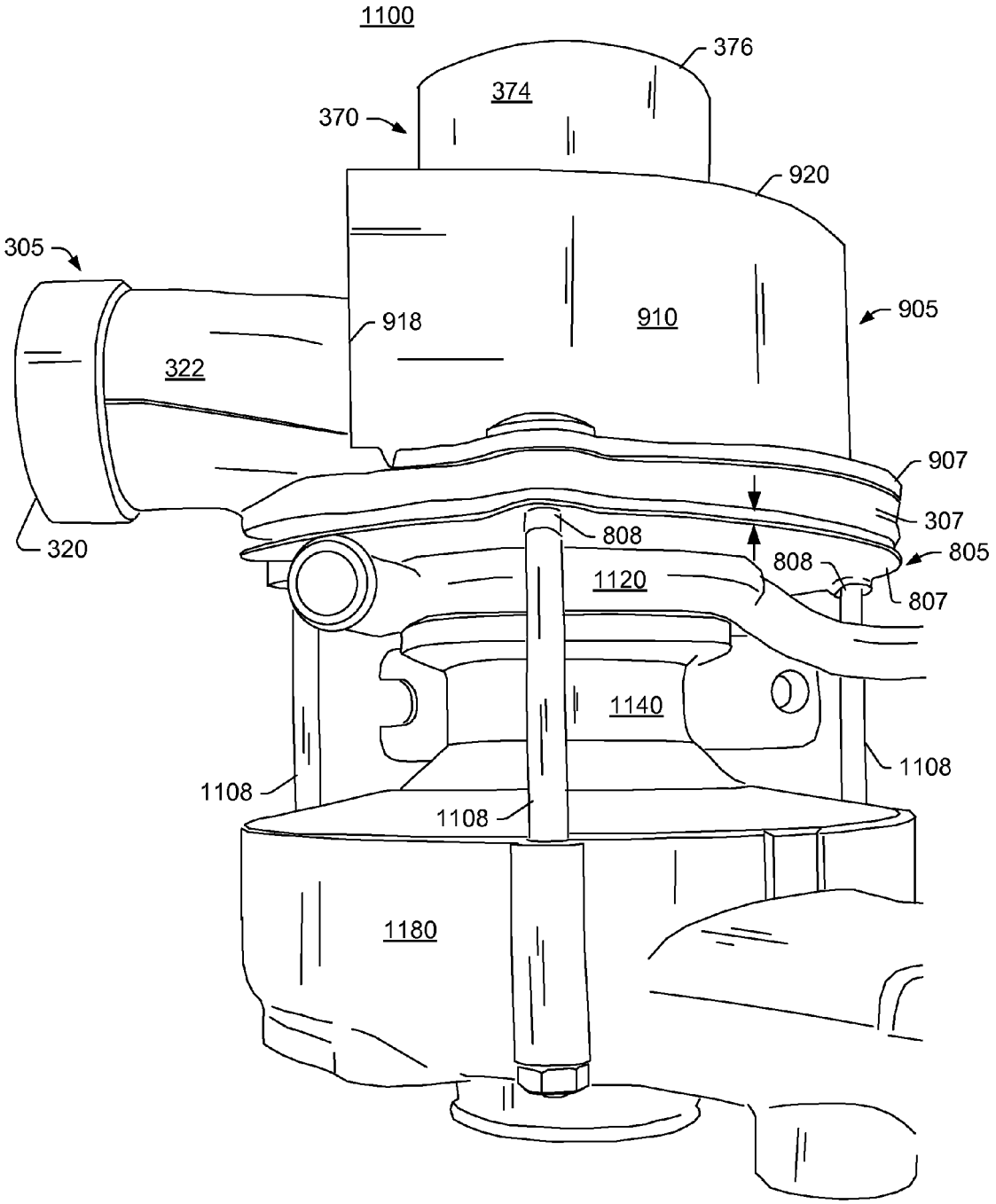
FIG. 11 is a perspective view of an example of an assembly that includes some of the components of the assembly of FIG. 10.

FIG. 11 shows a perspective view of an assembly 1100 that includes the assembly 1000 of FIG. 10 along with the heat shield 805 of FIG. 8 and a fluid conduit 1120, a bearing housing 1140 and a compressor assembly 1180. In the example of FIG. 11, rods 1108 extend from the burst shield 905 to the compressor assembly 1180 and clamp the bearing housing 1140. The cartridge component 305 provides structural rigidity and integrity to support clamping of the bearing housing 1140 between a turbine and a compressor. The heat shield 805 allows for the fluid conduit 1120 to be mounted without directly contacting the cartridge component 305. The fluid conduit 1120 can allow for flow of a cooling fluid to remove heat from the assembly 1100, particularly heat transferred to the heat shield 805. In FIG. 11, the conduit 1120 may be a fluid jacket. A US patent application entitled "Turbocharger bearing housing assembly", having Ser. No. 12/838,317 and filed Jul. 16, 2010 describes details of various housing and fluid jacket assemblies and is incorporated herein by reference.

Figure 12:
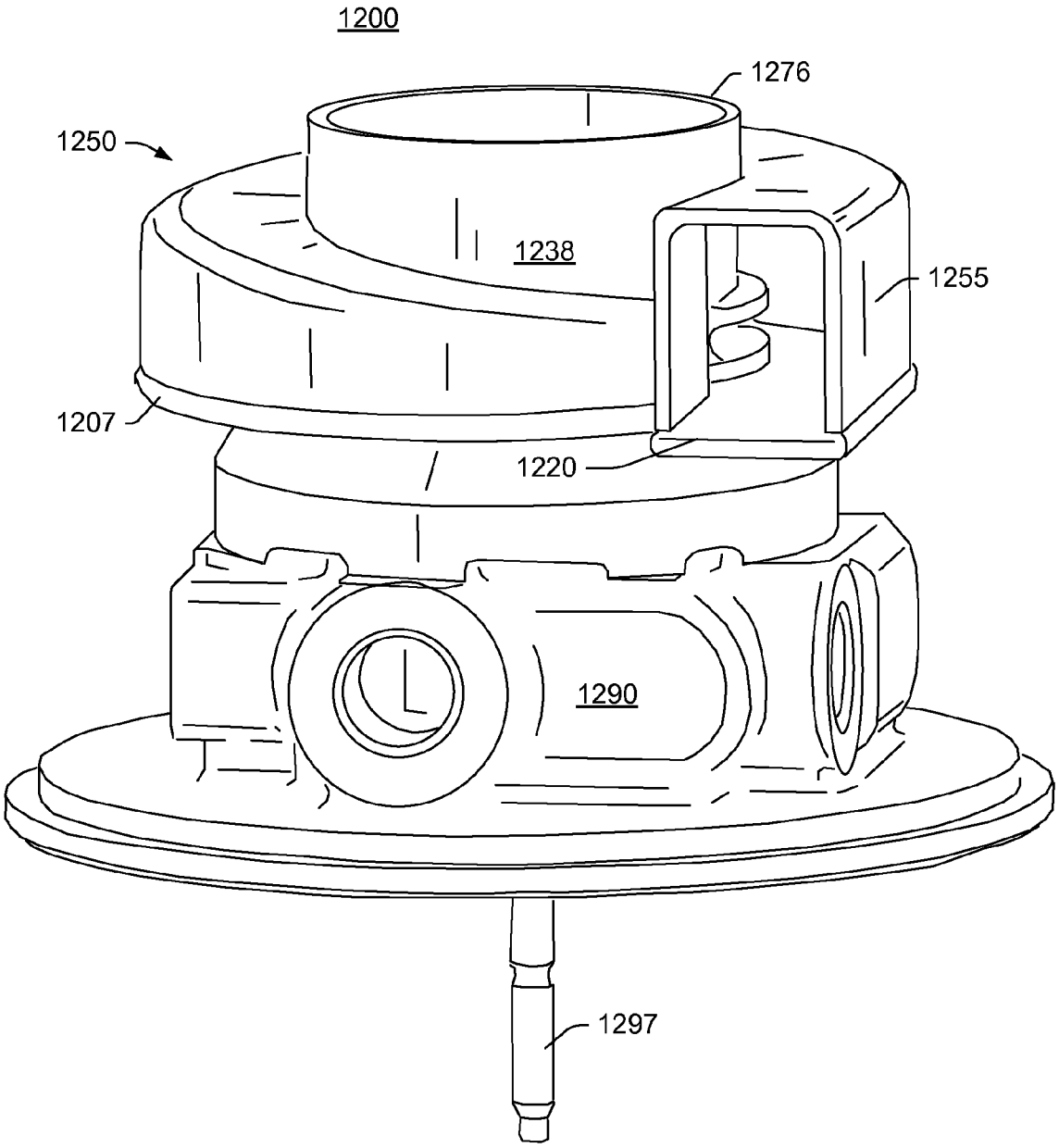
FIG. 12 is a perspective view of an example of a turbine assembly mounted to a center housing.

FIG. 12 shows an example of an assembly 1200 that includes a turbine assembly mounted to a center housing 1290 that supports a shaft 1297. In the example of FIG. 12, the turbine assembly includes a base portion 1207, a cylindrical portion 1538 and a volute wall 1250 that has at one end an opening portion 1255 that forms an opening 1220. The opening portion 1255 that may be configured as a fixture for attachment to an exhaust conduit. Hence, in this example, the fixture or fitting for an exhaust conduit is formed as part of the volute wall 1250 as in the example of FIG. 2 and in contrast to some other examples where a cast portion forms a fixture of fitting.

Figure 13:
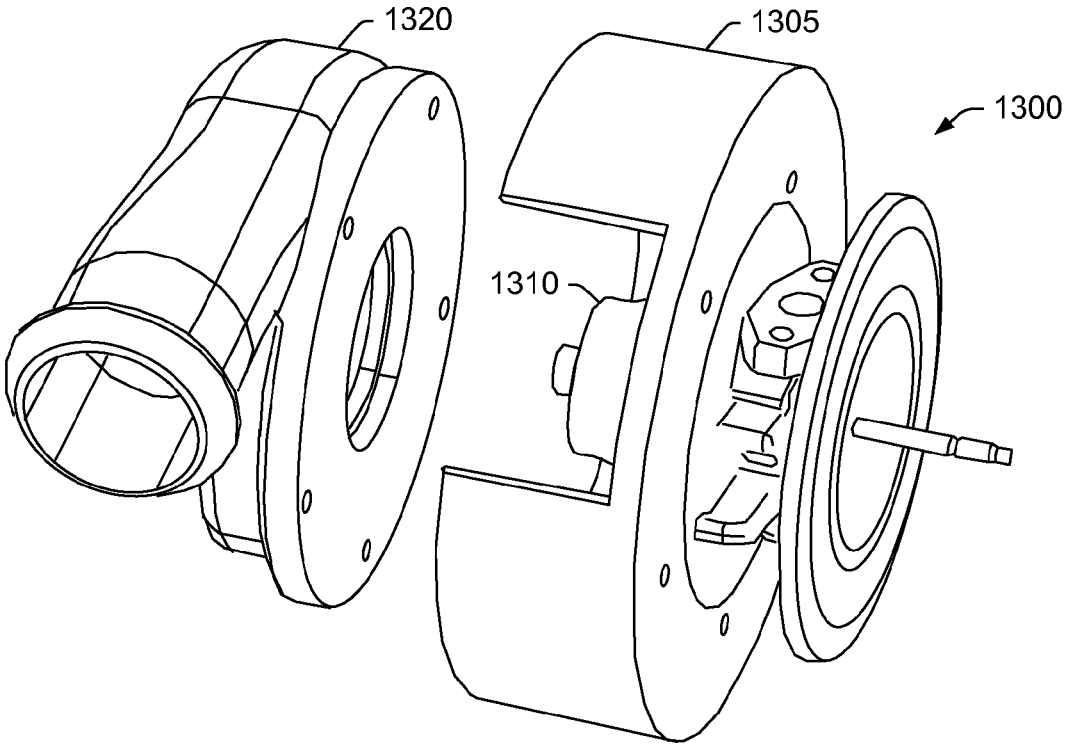
FIG. 13 is an exploded perspective view and a cross-sectional view of an example of a center housing that includes a burst shield.
Figure 13:
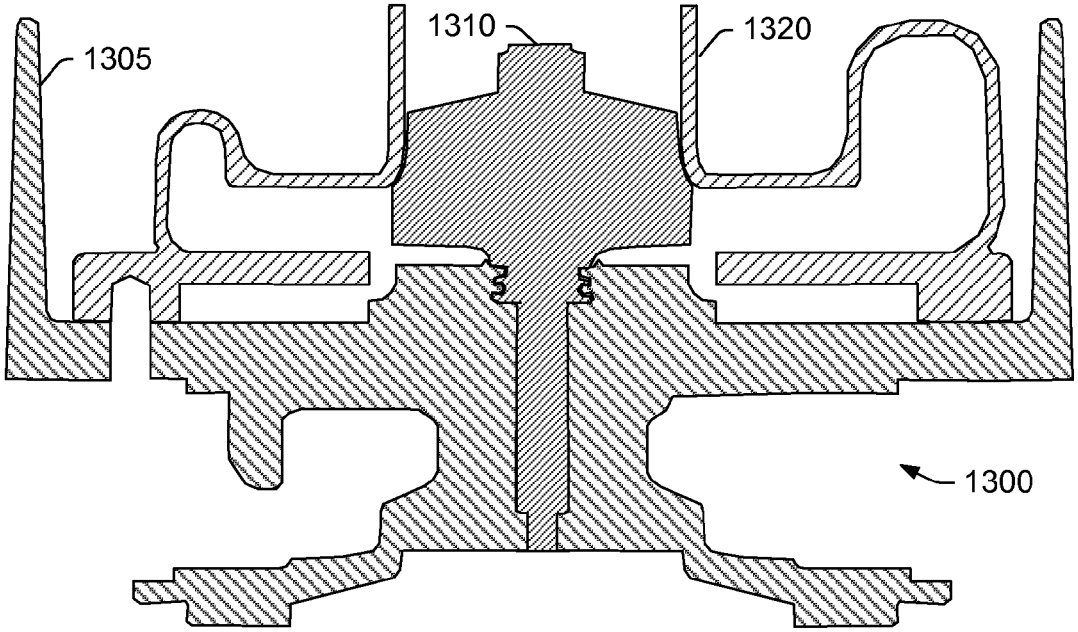

FIG. 13 shows an as center housing 1300 that includes an integral burst shield 1305. The housing 1300 may be cast and of sufficient integrity to impede debris in the instance of a burst turbine wheel 1310. The shield 1305 has a cylindrical shape with a cutout portion to accommodate an exhaust inlet for a volute. A turbine housing 1320 may be mounted onto the center housing 1300. As shown in the example of FIG. 13, the shield 1305 rises to at least the height of an exducer portion of the turbine wheel 1310. The shield 1305 may also provide for reduction of radiation from a turbine housing such as the turbine housing 1320.

Figure 14:
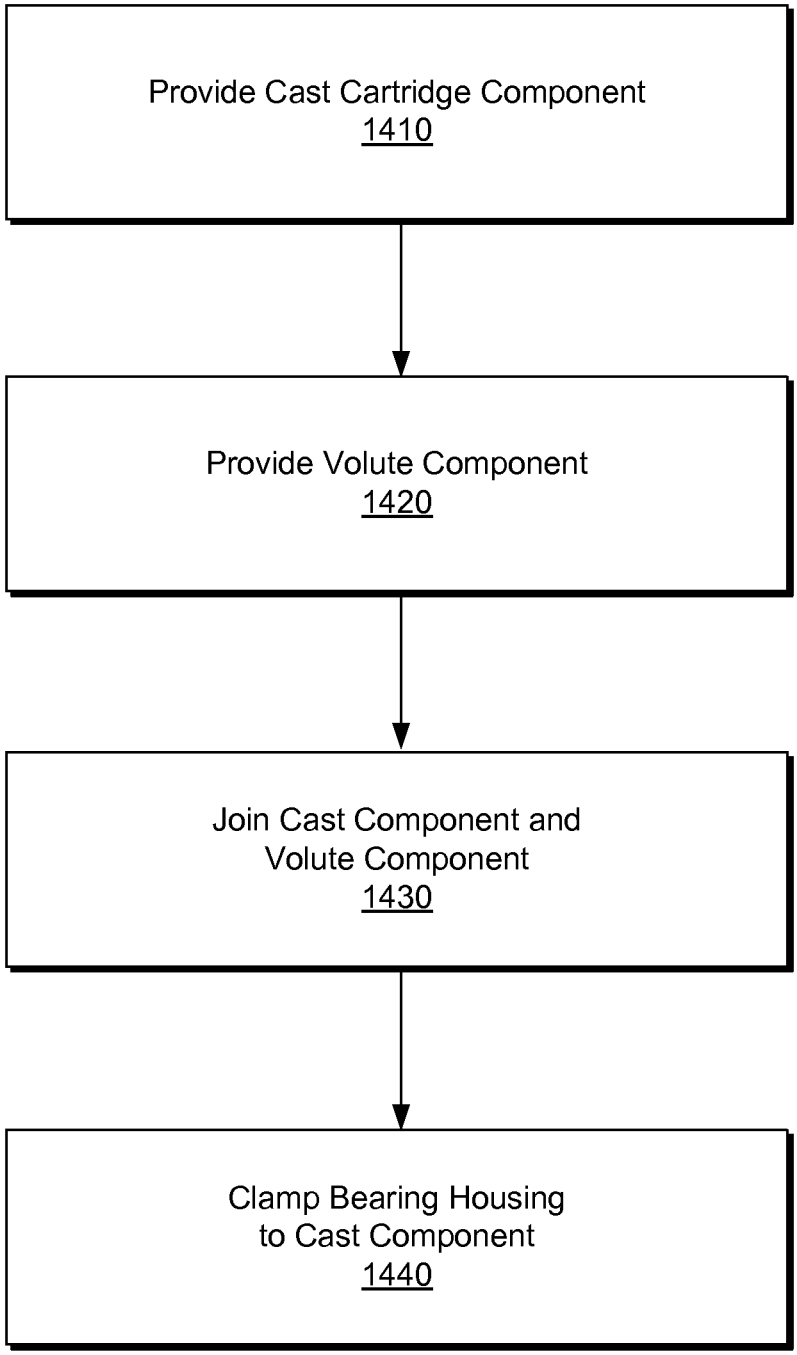
FIG. 14 is a diagram of a method for assembling turbocharger components.

FIG. 14 shows a block diagram of a method 1400 for assembling turbocharger components. The method 1400 includes providing a cast cartridge component 1410 and providing a volute component 1420. A join block 1430 includes joining the cast cartridge component and the volute component. A clamp block 1440 includes clamping a bearing housing to the cast cartridge component.

With respect to the cast cartridge component and the volute component, these components may include features of the components 305 and 350 of FIG. 3. The join block 1430 optionally includes welding the volute component to the cast cartridge component. The clamp block 1440 optionally includes clamping the bearing housing between the cast cartridge component and a compressor housing using, for example, rods that extend between the cast cartridge component and the compressor housing without contacting the bearing housing. Such an approach can reduce heat transfer between a turbine housing and a bearing housing. Further, such an approach can allow for enhance air flow to a bearing housing, which can enhance heat transfer from a bearing housing.

The method 1400 optionally includes mounting a heat shield to the cast cartridge prior to the clamping. The method 1400 optionally includes mounting a burst shield to the cast cartridge component prior to the clamping. The method 1400 optionally includes mounting a heat shield and mounting a burst shield to the cast cartridge component prior to the clamping. As described herein, clamping may help secure a heat shield, a burst shield or both a heat shield and a burst shield, for example, as shown in the assembly 1100 of FIG. 11.

Although some examples of methods, devices, assemblies, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. An assembly comprising:

a cast cartridge component, cast as a single piece that comprises a base plate that comprises an upper surface, a lower surface and an opening between the lower surface and the upper surface for receipt of a turbine wheel, an exhaust conduit having an inlet and an outlet, a cylindrical wall that comprises a lower surface, and fixed vanes cast between the cylindrical wall and the base plate that connect the base plate to the cylindrical wall wherein adjacent vanes define throats between the upper surface of the base plate and the lower surface of the cylindrical wall; and a curved wall that comprises a proximal end and a distal end, and an upper edge and a lower edge;

wherein joinder of the proximal end and the outlet of the exhaust conduit, joinder of the upper edge and the cylindrical wall and joinder of the lower edge and the upper surface of the base plate forms a volute configured to direct exhaust received via the inlet to a turbine wheel via the throats.

2. The assembly of claim 1 wherein the curved wall comprises a shape that corresponds to a specific turbine wheel.

3. The assembly of claim 1 comprising multiple curved walls having different shapes, the curved wall for joinder to the cast component selected from the multiple curved walls.

4. The assembly of claim 1 wherein the base plate comprises openings, each opening configured to receive a rod to clamp a bearing housing between the base plate and a compressor.

5. The assembly of claim 1 wherein the exhaust conduit comprises an axis oriented substantially parallel to a plane defined by the base plate.

6. The assembly of claim 1 wherein the exhaust conduit comprises a socket configured for joinder with the distal end of the curved wall.

7. The assembly of claim 1 further comprising joinder of the curved wall and the cast cartridge component.

8. The assembly of claim 7 wherein the joinder of the curved wall and the cast cartridge component comprises welded joints.

9. The assembly of claim 1 further comprising a heat shield configured for placement adjacent the base plate.

10. The assembly of claim 1 further comprising a conduit configured for joinder to the cylindrical wall.

11. The assembly of claim 1 wherein each of the vanes comprises a vane angle defined with respect to an axis of the cylindrical wall.

12. The assembly of claim 1 wherein each of the vanes comprises a vane shape.

13. An assembly comprising:

a cast cartridge component, cast as a single piece that comprises a base plate that comprises an upper surface, a lower surface and an opening between the lower surface and the upper surface for receipt of a turbine wheel, a cylindrical wall that comprises a lower surface, and fixed vanes cast between the cylindrical wall and the base plate that connect the base plate to the cylindrical wall wherein adjacent vanes define throats between the upper surface of the base plate and the lower surface of the cylindrical wall; and a curved wall that comprises a proximal end and a distal end, and an upper edge and a lower edge;

wherein the proximal end of the curved wall forms an inlet for exhaust and wherein joinder of the upper edge and the cylindrical wall and joinder of the lower edge and the upper surface of the base plate forms a volute configured to direct exhaust received via the inlet to a turbine wheel via the throats.

14. A method comprising:

providing a cast cartridge component, cast as a single piece that comprises a base plate that comprises an upper surface, a lower surface and an opening between the lower surface and the upper surface for receipt of a turbine wheel, a cylindrical wall that comprises a lower surface, and fixed vanes that extend between and connect the upper surface of the base plate and the lower surface of the cylindrical wall;

providing a volute component that comprises an upper edge configured to abut the cylindrical wall and an lower edge configured to abut the upper surface of the base plate;

joining the cast cartridge component and the volute component to form a volute defined in part by a surface of the volute component and a surface of the base plate; and clamping a bearing housing to the cast cartridge component.

15. The method of claim 14 wherein the joining comprises welding the volute component to the cast cartridge component.

16. The method of claim 14 wherein the clamping comprises clamping the bearing housing between the cast cartridge component and a compressor housing.

17. The method of claim 16 wherein the clamping comprises positioning rods to extend between the cast cartridge component and the compressor housing without contacting the bearing housing.

18. The method of claim 14 further comprising mounting a burst shield to the cast cartridge component prior to the clamping.

19. The method of claim 14 further comprising mounting a heat shield and mounting a burst shield to the cast cartridge component prior to the clamping wherein the clamping secures the burst shield.

* * * * *